United States Patent [19]

Fredd

[11] 4,453,599

[45] Jun. 12, 1984

[54] METHOD AND APPARATUS FOR CONTROLLING A WELL

[75] Inventor: John V. Fredd, Dallas, Tex.

[73] Assignee: Otis Engineering Corporation, Dallas, Tex.

[21] Appl. No.: 376,298

[22] Filed: May 10, 1982

[51] Int. Cl.[3] ..... E21B 34/14; E21B 43/12; E21B 47/06; E21B 33/12

[52] U.S. Cl. ..... 166/374; 166/150; 166/184; 166/250; 166/321; 166/332

[58] Field of Search ..... 166/374, 373, 383, 386, 166/321, 319, 332, 316, 149, 150, 151, 152, 131, 184, 183, 188, 185, 186, 369, 54.1, 250, 334; 251/63, 63.5

[56] References Cited

U.S. PATENT DOCUMENTS

| | | | |
|---|---|---|---|
| 3,375,874 | 4/1968 | Cherry et al. | 166/321 |
| 3,494,417 | 2/1970 | Fredd | 166/73 |
| 3,964,305 | 6/1976 | Wray et al. | 166/321 |
| 4,274,486 | 6/1981 | Fredd | 166/332 |

*Primary Examiner*—Ernest R. Purser
*Assistant Examiner*—Hoang C. Dang
*Attorney, Agent, or Firm*—Vinson & Elkins

[57] ABSTRACT

A method and apparatus for annulus flow systems in which a safety valve controls flow adjacent the packer and the safety valve is operated by control of tubing pressure exerting an upward force on the valve operator and an urging device such as a weight string of tubing exerting a downward force on the operator. In one form the control valve is a foot valve below the packer which is automatically closed by removal of the actuator. In other forms the control valve is removable with the tubing string and a separate foot valve may be provided below the packer, if desired. The system may be designed to close the safety valve in direct response to a reduction in pressure in the well annulus, or it may be designed to reduce or increase tubing pressure and close the safety valve in response to any well condition sensed at the surface which would include a reduction in annulus flow pressure.

Provision is made for a pressure sensing instrument to be associated with the control valve and the control valve may be opened and closed by changing tubing pressure to obtain well data. In one form when the sensing instrument is removed the tubing is automatically closed. In another form after the sensing instrument is removed, a plug is run to close the lower end of the tubing.

34 Claims, 8 Drawing Figures

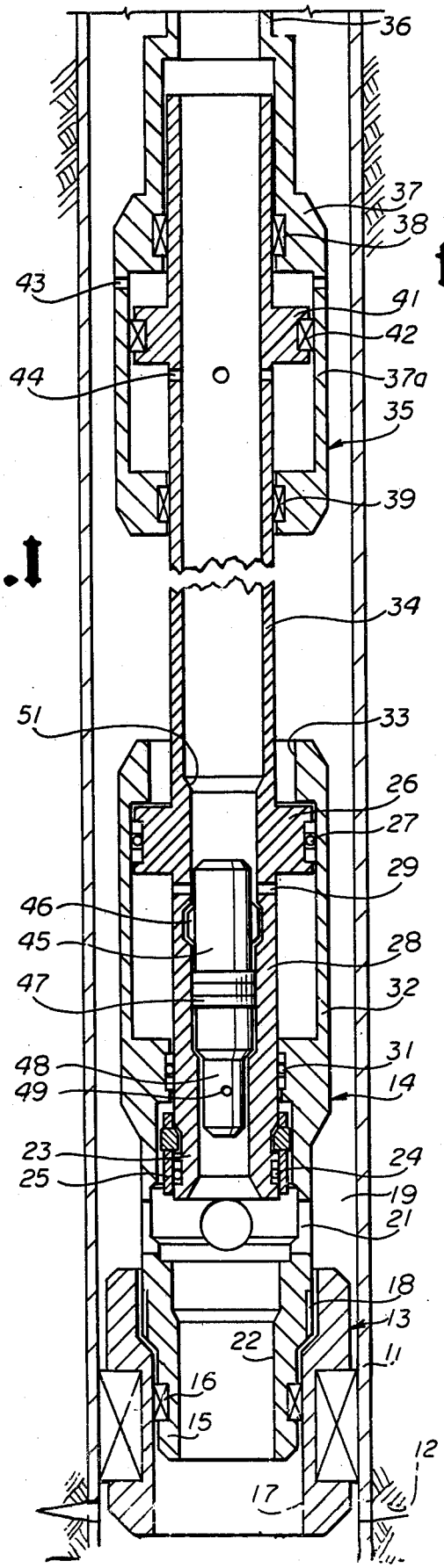
fig.1
fig.2
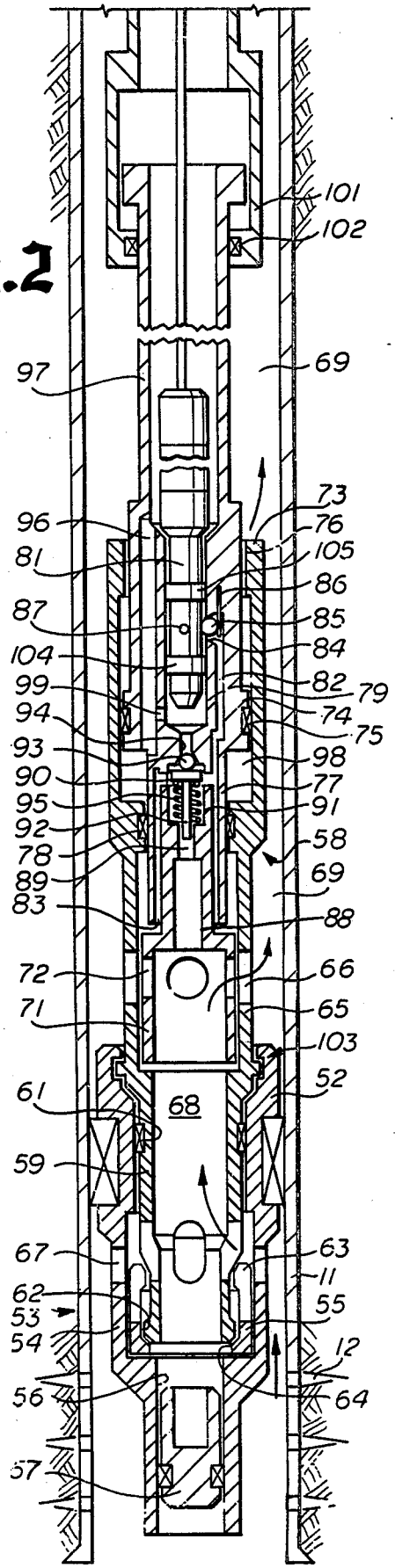

METHOD AND APPARATUS FOR CONTROLLING A WELL

This invention relates to method and apparatus for controlling a well.

Wells which produce large volumes of petroleum products may be produced through the casing-tubing annulus. Desirably, the control of flow in such wells is provided, in some instances, at the area of the packer which is normally set adjacent the flowing formation. See U.S. Pat. No. 3,375,874.

It is also frequently desirable to be able to obtain well flow data, such as pressure build up curves, utilizing systems in which the measuring instrument and the control valve is adjacent the flowing formation and it would be advantageous to have a deep well subsurface safety valve which could also function as the valve controlling flow to permit this accumulation of data.

An object of this invention is to provide a method and apparatus for obtaining well data utilizing a valve positioned adjacent the flowing formation which valve also functions as a subsurface safety valve.

Another object is to provide a method and apparatus as in the preceding object in which the safety valve may be designed to close in response to pressure conditions in the casing-tubing annulus or may be designed to be closed in response to changes in a control pressure which pressure is in turn controlled at the surface by conditions sensed at the surface in the conventional manner.

Another object is to provide a method and apparatus located adjacent the flowing formation for controlling flow through the casing-tubing annulus in which the valve is controlled by pressure within the tubing exerting a pressure in one direction and an urging means, such as a weight string of tubing, exerting a pressure in the other direction.

Another object is to provide a method and apparatus for controlling flow adjacent a well formation in which flow through the casing-tubing annulus is controlled by tubing pressure exerting an upward force on an actuator opposed by a weight string of tubing urging the actuator downwardly.

Another object is to provide a method and apparatus as in the preceding object in which a travel joint is provided in the tubing to permit free reciprocation of the weight string of tubing.

Another object is to provide a subsurface safety valve positionable adjacent the flowing formation in conjunction with a pressure sensitive instrument for obtaining well data by opening and closing the safety valve in which the instrument is exposed to formation conditions in all positions of the safety valve and when the instrument is withdrawn the passageway providing such exposure is automatically closed.

Another object is to provide a subsurface safety valve positioned adjacent the flowing formation with a purge valve.

Another object of this invention is to provide an annulus flow control system and method in which the effect of tubing pressure on a valve operator is opposed by an urging means which may be readily varied in power to meet well conditions.

Another object is to provide an annulus flow control system and method in which the effect of tubing pressure on a valve operator is opposed by a weight string of tubing which may include as many lengths of tubing as desired to meet well conditions.

Another object is to provide a subsurface safety valve for controlling annulus flow which may also be utilized in conjunction with a measuring instrument to obtain well data while controlling the flow at a point adjacent the producing formation.

Another object is to provide an annulus flow control system and method in which the flow control valve is controlled at least in part by tubing pressure and means are provided for purging the tubing to reduce the liquid level within the tubing.

Another object is to provide an annulus flow control system and method in which the effect of tubing pressure on a valve operator is opposed by a weight string of tubing in which the pressure responsive means exposed to tubing pressure may be readily and easily compounded and the weight string of tubing may include as many stands of tubing as desired to accommodate well conditions.

Another object is to provide an annulus flow control system and method in which a subsurface safety valve is provided in conjunction with a well packer for controlling flow through the annulus and in which the control valve is a foot valve which remains in the well and is automatically closed when the tubing string is pulled.

Another object is to provide a system and method as in the preceding objects in which the operator for the safety valve is urged downwardly by a weight string of tubing and upwardly by tubing pressure.

Another object is to provide a system and method as in the preceding objects in which gas lift valves may be provided in the tubing above the safety valve and the lifting gas aids the flow of oil up the annulus and act as the control fluid.

Other objects, features and advantages of the invention will be apparent from the specification, the drawings and the claims.

In the drawings wherein illustrative embodiments of this invention are shown and wherein like reference numerals indicate like parts:

FIG. 1 is a schematic view in section illustrating a packer, subsurface safety valve and travelling joint constructed in accordance with this invention;

FIG. 2 is a view similar to FIG. 1 illustrating a modified form of this invention;

Figure 5A:
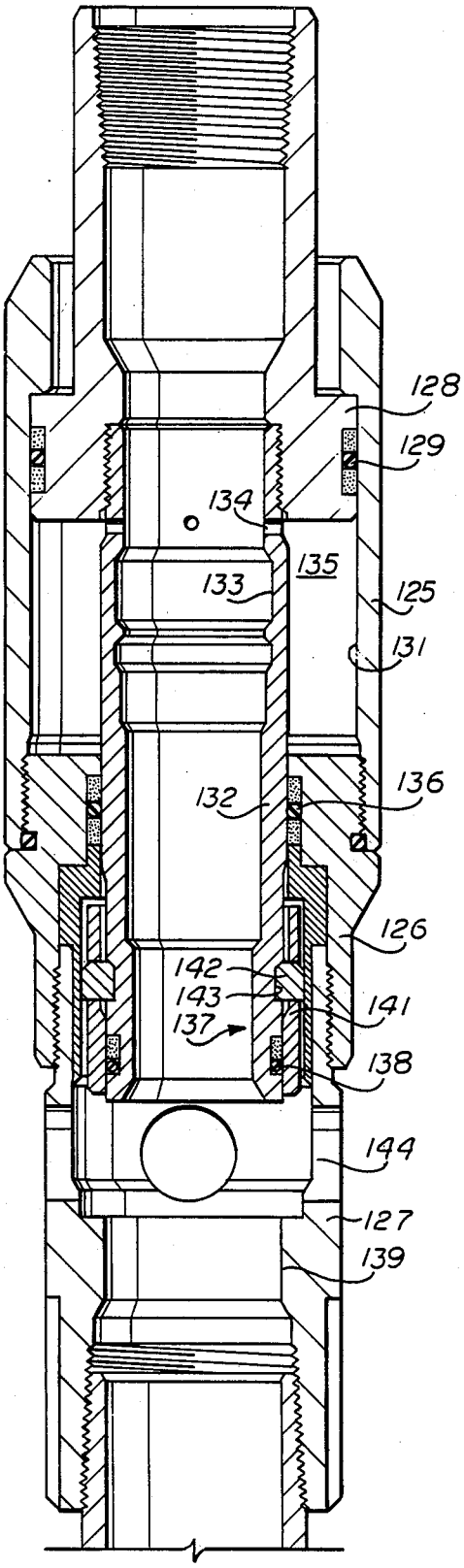
Figure 5B:
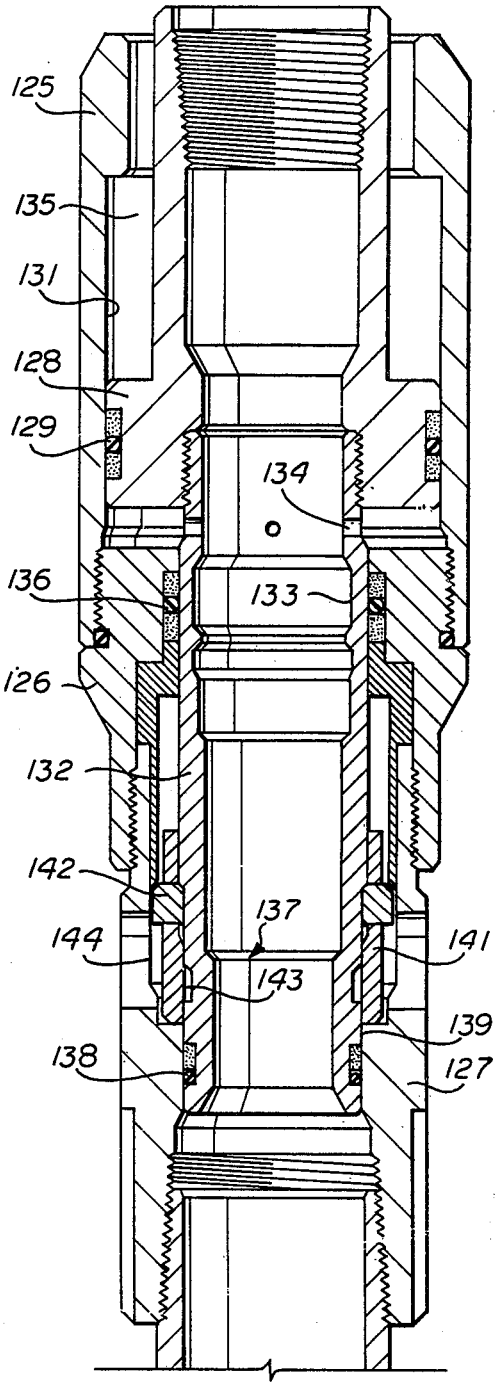

FIGS. 5*a* and 5*b* are sectional views of a subsurface safety valve primarily for use in the FIG. 1 form of this invention with the valve shown open in FIG. 5*a* and closed in FIG. 5*b;*

Figure 7:
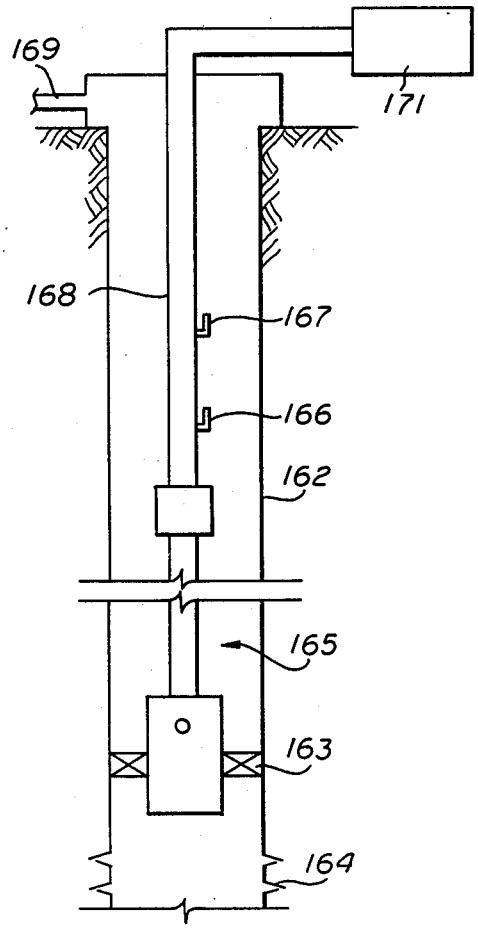
Figure 6:
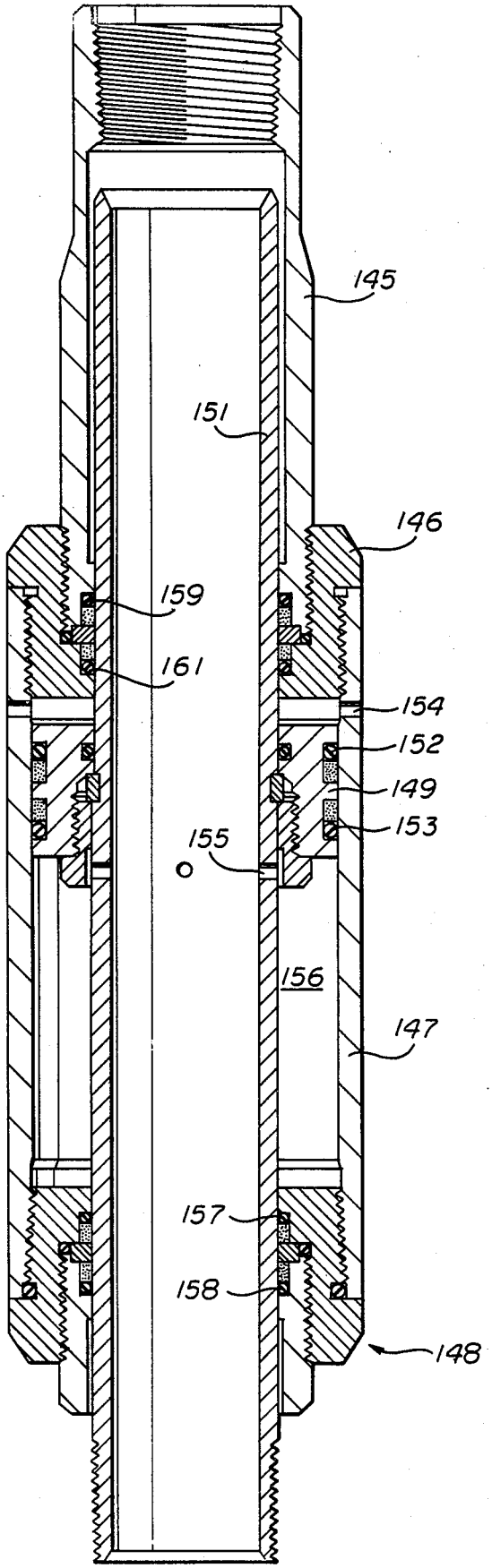

FIG. 6 is a sectional view through a travel joint primarily for use with the FIG. 1 form of this invention; and FIG. 7 is a schematic illustration of a well equipped with the subsurface safety valve of this invention and for gas lifting fluids in the well.

In practicing the methods of this invention a subsurface safety valve and packer are positioned in the well immediately adjacent a producing formation. The safety valve provides for flow passing through the packer to be valved into the annulus so that flow is to the surface through the casing tubing annulus. A means such as a travelling joint is provided in the tubing and a weight string of tubing interconnects the travelling joint and the operator for the safety valve.

A pressure responsive means or piston within the safety valve is exposed to tubing pressure on its downwardly facing side. The piston may also be exposed to casing pressure on the upwardly facing side. The force of tubing pressure acting upwardly opposes the weight of the weight string of tubing between the safety valve and the travelling joint. If a differential is present, tubing pressure opposes the weight string of tubing and the downward force of the annulus pressure.

With the valve positioned in the well, a pressure sensing instrument is landed in the valve. The lower end of the tubing is closed, either by design or by landing the pressure sensing instrument in the valve. After the instrument is landed, the tubing pressure may be adjusted to open the valve and permit flow from the formation through the packer and valve to the surface. Then the pressure within the tubing may be adjusted to cause the subsurface safety valve to close and pressure within the well at the formation permitted to build up to obtain pressure build-up data. By positioning the valve immediately adjacent the formation, the data will not be distorted as is the case where the formation flow is controlled at the surface.

After pressure data has been obtained the pressure sensing instrument is pulled from the well and the bottom of the tubing closed at the safety valve. This closure may be automatic or where an open bore through the safety valve is provided, a plug is run in and landed in the safety valve to plug the lower end of the tubing. The system may include a purging valve and a desired amount of liquid may be provided in the tubing with a gas cap on top to provide the tubing pressure. If desired, the liquid may be reduced in level by pressuring up to force it out of the purging valve. The purging valve will also permit purging of trash from the tubing. The pressure within the tubing is set at a level which will maintain the subsurface safety valve in open position. Thereafter, a drop in either tubing or annulus pressure, depending upon the particular design employed, will result in closing of the subsurface safety valve. Thus, the valve is operable as a subsurface safety valve in the conventional manner to close in response to surface control or surface conditions, such as a catastrophe at the wellhead. The differential across the control piston will be sufficient to oppose the weight of the weight string of tubing to maintain the valve in the desired flow position. This flow position may be one in which the tubing pressure is sufficient to overcome the weight of the weight string of tubing and hold the valve in an up open position. In another form it may be provided that the valve is open in a down position under the influence of the weight string of tubing and annulus pressure and the amount of tubing pressure provided is such that it does not close the valve except upon the loss of the casing annulus pressure and such loss will result in a sufficient differential across the safety valve operator that the weight string of tubing is overcome and the valve moved upwardly to closed position.

Thus, the method permits controlling flow adjacent the formation to obtain data on well conditions at any time during the life of the well and provides for control of flow during normal production with a subsurface safety valve responsive to surface conditions or to pressure in the annulus.

Referring first to FIG. 1, the well has a casing 11 providing for flow from the producing formation 12.

A packer, indicated generally at 13, is positioned immediately above the formation. In the form illustrated the packer 13 is a conventional packer set by wireline procedures.

Landed in the packer 13 is an assembly including the subsurface safety valve, indicated generally at 14. Where a wireline packer is used the safety valve 14 includes on its lower end a stinger or tailpipe 15 having seal means 16 thereon for sealing with the bore 17 through the packer. Also, if desired, the tailpipe may be secured to the packer by any desired means, such as the J-slot indicated schematically at 18. If desired, the weight of the assembly may be sufficient to maintain the assembly within the packer or the attachment means such as J-slot 18 may be utilized. Where a J-slot is utilized a suitable spline is provided between the various parts of the valve and the travel joint so that rotation of the tubing will result in rotation of the tailpipe 15.

The subsurface safety valve may take any desired form which provides for flow from the passageway through the packer 13 into the casing tubing annulus 19. In the form illustrated ports 21 are provided to conduct flow from the bore 17 in the packer and the bore 22 in the tailpipe 15 to the annulus 19.

Flow through the ports 21 is controlled by a valve member 23 having an external seal 24 and a shutter 25 which operates in the conventional manner to protect the seal 24 in moving between open and closed positions.

A pressure responsive member such as piston 26 having seal 27 thereon is provided for reciprocating the valve member 23 between open and closed positions. The piston 26 is connected to the valve 23 by a tubular connecting rod 28 and suitable ports 29 are provided for conducting fluid from the interior of the tubular connecting rod 28 to the underside of the piston 26. A seal 31 seals between the valve body 32 and the connecting rod 28 to provide a pressure responsive area defined by the seals 31 and 27 exposed to tubing pressure urging the piston 26 upwardly. The piston is exposed on its top side to casing pressure entering through the bore 33 in the upper end of body 32. The effective area of seals 31 and 24 may be selected to obtain any desired conditions.

A weight string of tubing 34 which may be any desired number of stands of tubing extends upwardly from the piston 26 and terminates in the travel joint indicated generally at 35.

The travel joint 35 is secured to the lower end of the well tubing 36 and includes a housing 37 having upper and lower seals 38 and 39 which may be of identical diameters which seal with the weight string of tubing 34.

The weight string of tubing 34 carries a pressure responsive member such as piston 41 having a sliding seal 42 thereon which seals with an enlarged section **37*a* of body 37, thus providing a pressure responsive area above and below the seal 42 defined by the difference in diameter of the seal 42 and the two seals 38 and 39**.

Fluid reaches the travelling joint piston 41 by passing from the annulus through ports 43 in the body 37 and from the tubing through ports 44 with the ports 43 arranged above the piston and the ports 44 arranged below the piston so that tubing pressure acts upwardly in a manner to lift the weight string of tubing when tubing pressure exceeds the annulus pressure. By designing the travelling joint to have pressure responsive areas exposed to casing and tubing pressure in the same manner as the piston 26 of the safety valve, the travelling joint acts as a compounding joint and compounds the force of tubing pressure acting on the system so that as tubing pressure is raised above annulus pressure the areas of the travelling joint piston 41 and the safety valve piston 26 are subject to this differential and both urge the valve member upwardly against the weight of the tubing string 34. It will be appreciated that additional safety valve pistons or travelling joint pistons may be provided to further compound the system and provide additional areas subject to differential to raise the safety valve to open position.

Shown landed in the connecting rod 28 of the valve is a plug 45, including latching dogs 46 and seal 47. The plug is landed and latched using conventional equipment and procedures. The seal 47 seals the lower end of the tubing at the safety valve and permits the tubing to be filled with gas and/or liquid to exert an upward force on the safety valve piston 26 and the travelling joint piston 41.

The plug may carry at its lower end a purging valve 48 which permits purging of liquid and trash from the tubing through the port 49.

In operation the packer 13 will normally be first set by conventional techniques. Then the well string 36 including the subsurface safety valve and travelling joint 35 will be run in and landed in the packer 13. A pressure sensing instrument, such as disclosed hereinafter, may be run in and landed on the shoulder 51 just above the piston 26 to extend into the bore through the tubular connector 28. If desired, the pressure sensing instrument may also have a latch means such as the means 46 for latching it in the tubular connector 28. The sensing instrument would also have packing such as packing 47 on the plug 45 which would be positioned below the ports 29.

At this time pressure within the tubing would be increased to exceed the pressure within the annulus and open the subsurface safety valve to establish flow from the formation and up through the annulus.

When it is desired to obtain pressure build up data, the valve is closed by reducing the pressure within the tubing 36 to a value at which the weight string of tubing 34 and the annulus pressure will move the piston 26 downwardly to close the valve. As the valve and pressure sensing instrument are located immediately adjacent the producing formation 12, pressure build-up data may be obtained which reflects actual conditions at the formation 12.

If desired, the pressure sensing instrument may be withdrawn and a plug such as plug 45 run in and landed in the tubular connector 28 and thereafter the tubing 36 will be pressurized to a value at which the subsurface safety valve moves to the open position shown in FIG. 1.

Thereafter in accordance with conventional procedures the position of the safety valve may be controlled by wellhead equipment which is responsive to any desired occurrence at the wellhead to reduce the pressure within the tubing 36 and close the valve upon command of the control system. Thereafter, repressurizing of the tubing will return the valve to open position.

FIG. 2 shows a modified form of the invention in which the packer 52 includes a foot valve, indicated generally at 53. The lower end of the tubing is closed by the subsurface safety valve without need for a plug being run into the well after testing has been completed.

The packer 52 has depending therefrom the foot valve 53 which includes the valve body 54 and a valve member 55. The lower portion of the body 54 has a bore 56 therethrough and a plug 57 removably landed in the bore 56.

The subsurface safety valve indicated generally at 58 has a tailpipe 59 which extends through packer 52 and is provided with seals 61 for sealing with the bore through the packer. The tailpipe has an outwardly extending flange 62 thereon which cooperates with collet fingers 63 extending upwardly from the foot valve member 55 and flange 64 in the valve member so that as the subsurface safety valve is landed in the packer the flange 62 on the tailpipe engages the inturned flange 64 in the slide valve 55 and moves it to full open position. When the subsurface safety valve is pulled, the flange 62 on the tailpipe engages the inturned collet fingers 63 to move the foot valve 55 to closed position and then release the collet fingers to permit the subsurface safety valve to be pulled from the hole.

The subsurface safety valve 58 has a body 65 with ports 66 therein which conduct flow from the foot valve ports 67 through the tailpipe bore 68 to the annulus 69.

The valve 58 includes a slide valve member 71 having ports 72 therein which align with the ports 66 when the valve member is in the down and open position to permit flow from the formation through the packer and valve into the annulus 69.

The safety valve 58 has a body 73 in which the pressure responsive member provided by piston 74 carrying seal 75 reciprocates. The body has an open bore 76 at its upper end so that the piston 74 is exposed to annulus pressure on its upper side. The connecting member 77 between the piston 74 and the valve 71 has a sliding seal with the body provided by seal 78 carried in the body 73. The piston has a bore 79 therein for receiving a measuring instrument 81. A flowway 82 extends vertically in the piston and terminates at its lower end at the inlet 83 and at its upper end in a valve seat 84. A valve member 85 is held against the seat by the leaf spring 86 when the sensing instrument is not in position in the bore 79. When the sensing instrument 81 is in position the diameter of the ball valve 85 is such that it is engaged by the measuring instrument 81 and held off of its seat so that flow from the formation may pass through the passageway 82 and into the measuring instrument through the port 87 therein.

The passageway 82 joins with an inwardly projecting ports 90 which also receives fluid from the bore 88 in the connecting member just above the valve member 71 through the bores 89 and 91. Thus, in any position of the valve member 71 the passageway 82 will always receive formation pressure.

A purge valve is provided by a valve follower 92 reciprocal in the bore 89 bearing against a valve 93 which controls flow through the port 94 in the piston 74. A suitable spring 95 urges the follower upwardly to hold the ball 93 against its seat.

The piston 74 has a bypass passageway 96 which at its upper end opens into the weight string of tubing 97 and at its lower end opens into the chamber 98 below the piston 74. The passageway 96 has an inturned branch 99 communicating with the passageway 94 so that fluid within the weight string of tubing 97 can bypass the measuring instrument 81 and be effective against the purge valve to purge the tubing with the measuring instrument in place, if desired. The branch 99 also permits fluid in bore 79 to be displaced when measuring instrument 81 is inserted or removed.

Above the weight string of tubing 97 is the travelling joint including the body 101 having a sliding seal 102 which slidably seals with the weight string 97.

The seal 102 may be of equal area with seal 78, if desired.

In the operation of the FIG. 2 form of the invention, the packer 52 will be run and set. If the foot valve 55 is in open position the packer may be run with the plug 57 in place. After the packer is set the tubing string having the subsurface safety valve and travelling joint thereon are run into the well and landed in the packer and may be latched thereto by any suitable means, such as indicated at 103.

When the subsurface safety valve is landed it will be in the open position due to the weight of the weight string of tubing 97. After the tubing is run, the sensing instrument 81 will be run in and landed, as shown in FIG. 2. Thereafter, the well may be opened at the surface to permit flow through the annulus to obtain flowing well data. When it is desired to obtain shut in data, the tubing is pressured to the extent necessary to drive piston 74 upwardly against the force exerted by the string 97 moving the valve member 71 to the closed position. At this time well fluids flowing up through bore 68, 88 and 89 and through the passage 82 will find its way past the check valve 85 and through port 87 into the measuring instrument. This fluid is trapped by the seals 104 and 105 on the sensing instrument 81.

After shut in well data has been accumulated and it is desired to flow the well, the pressure within the tubing will be reduced slightly beyond the value needed to move the valve member 71 down to the open position, as shown.

Thereafter, the well is produced in the normal manner through the annulus. In the event something occurs that reduces the back pressure against the fluid flowing up through the annulus 69 permitting this pressure to reduce, the differential across the piston 74 would increase and result in the piston moving upwardly to move the valve 71 to closed position. Thus, the subsurface safety valve operates to move to closed position in the event of some occurrence which results in a reduction of pressure in the annulus 69. A pilot control system may also be used to add liquid to the tubing or to increase tubing pressure and close the valve in the event of an undesirable change in conditions.

When it is desired to pull the string of tubing the latch 103 is disengaged and the tubing raised to pull it from the packer 51. When this occurs the flange 62 on the tailpipe would engage the collets 63 and move the foot valve to closed position before the tailpipe is released by the collet fingers 63.

The sensing instrument 81 will normally be pulled prior to placing the well on production and when it is removed from the safety valve the ball 85 will be held firmly on its seat by leaf spring 86 to permit pressure within the tubing to be increased to that needed to move the valve to closed position.

Figure 3:
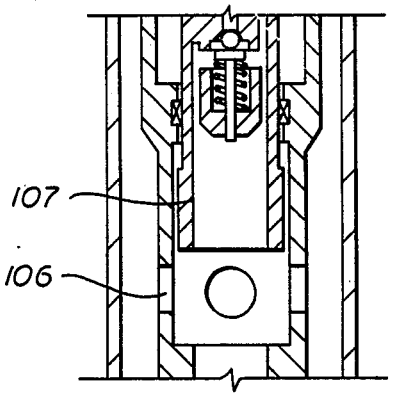
FIG. 3 is a fragmentary schematic sectional view similar to FIG. 2 showing a modification of the valve of FIG. 2.

FIG. 3 illustrates a modification of FIG. 2 in which the subsurface valve is open in the upper position instead of in the lower position in FIG. 2. In this instance the flow ports 106 are open when the valve 107 is in the upper position and closed when the valve is in the lower position. Other than this change the valves are essentially identical, except in their operation.

In operation of the FIG. 3 form of valve the tubing pressure must be increased to a value greater than casing pressure to the extent needed to overcome the force of the weight string of tubing to move the valve to open position. Then, as in the case of the FIG. 1 form of valve, a reduction in tubing pressure moves the valve to closed position. This form of valve operates in essentially the same manner as previously explained in connection with FIG. 1.

Figure 4:
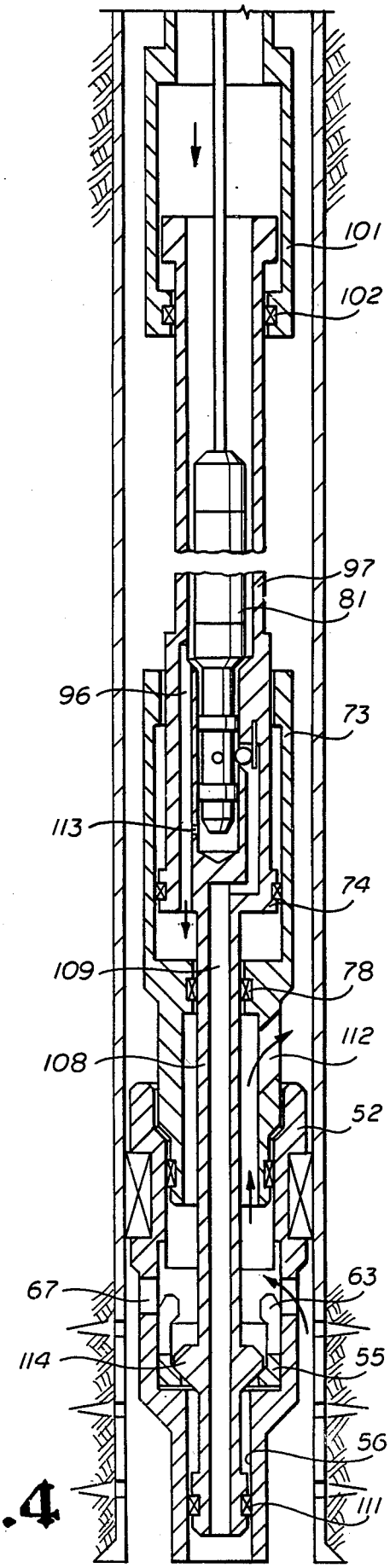
FIG. 4 is a schematic view in section showing a further modified form of this invention.

The form of invention shown in FIG. 4 is similar to the FIG. 2 form of the invention, except that instead of having the subsurface safety valve between the operator piston and the packer, the foot valve is operative as the subsurface safety valve.

The packer 52 and the foot valve are the same in construction as shown in FIG. 2. The travel joint is the same and the operating piston 74 and its housing 73 are substantially the same. Again, tubing fluid flows through the bypass passageway 96 to be effective and urge the piston 74 upwardly. Below the piston 74 the valve is provided with a stringer 108 which depends from the piston 74 and extends down through the packer and the foot valve. The stinger 108 has a bore 109 therethrough which conducts fluid from the formation up to the measuring instrument 81.

The stringer 108 has a seal 111 on its lower end which slidably seals the passageway 56 and closes this passageway to flow of fluid through the packer bore and ports 112.

In operation the packer 52 is run and set. Thereafter, the tubing string with the travel joint and piston 74 and tailpipe 108 are run into the well and the housing 73 of the operator system landed in the packer, as shown. At this time the tailpipe extends through the packer. As the tailpipe reciprocates the foot valve is opened and closed to function as a safety valve.

After the operator is run the pressure sensing instrument 81 will be run in and landed. A port 113 is provided to equalize pressure across the sensing device 81 and permit it to be seated without encountering a pressure block.

The well may be permitted to flow to obtain flowing well data. When it is desired to obtain pressure build up data, the tubing is pressurized to raise the piston 74 which in turn will raise the tailpipe and its actuating flange 114 to engage the collet fingers 63 and move the foot valve to closed position. The pressure build up data may now be obtained and measured by the instrument 81.

Thereafter, the instrument 81 may be removed and the foot valve operated as a safety valve in the same manner as explained in conjunction with FIG. 1.

Referring now to FIGS. 5A and 5B, there is shown a preferred form of safety valve for use with systems such as that shown in FIG. 1.

The valve of FIG. 5 includes an upper housing 125, a reducing sub 126 and a ported sub 127.

A pressure responsive member is provided in the housing by piston 128 having the seal 129 in sliding engagement with the bore wall 131.

Depending from the piston 128 is a landing nipple 132 having the conventional grooves 133 therein for landing equipment. Ports 134 in the landing nipple communicate the interior of the nipple with the chamber 135 below the piston 128.

A seal 136 is provided in the reducing sub 126 which slidably seals with the landing nipple 132 to define the chamber 135.

The lower end of the landing nipple 132 provides a valve member, as indicated generally at 137. The valve member includes the seal member 138 for slidably engaging the valve seat 139 in the ported sub. To protect the seal 138, a shutter 141 is carried by the valve member. The shutter has a dog 142 which is retained within the groove 143 as the valve moves downwardly from the 5A position toward the 5B position. As the seal 138 moves into the bore 139 the dog is released and falls into the groove 144 to release the shutter from the valve member. In movement of the valve upwardly from the 5B position to the 5A position, the dog 142 will again fall into the groove 143 and carry the shutter upwardly with the valve member in the conventional manner.

The valve of FIG. 5 or any other desired form of valve and operator may be utilized in this invention.

FIG. 6 shows a form of travel joint.

A neck 145 has a cylinder head 146 depending therefrom and a cylinder 147 depending from the cylinder head. The bottom of the cylinder 147 is closed by a gland assembly, indicated generally at 148.

Reciprocal within the cylinder 147 is the pressure responsive member provided by piston 149 which is carried by the weight string of tubing 151. The piston 149 has a pair of seals 152 and 153 which slidably seal with the cylinder 147.

At the bottom of the cylinder head the cylinder has a plurality of ports 154 which permit annulus pressure to be effective on the top of the piston 149.

The weight string of tubing has a plurality of ports 155 positioned just below the piston 149 which provide for tubing pressure to pass through the ports and into the chamber 156 below the piston 149. The chamber 156 is completed by the seals 157 and 158 in the gland assembly which seal between the gland and the weight string of tubing.

The neck and cylinder head have a sliding seal with the weight string of tubing 151 provided by seals 159 and 161 to maintain fluid integrity between the neck 145 and the weight string of tubing.

As prevously explained, the casing pressure enters through ports 154 and is effective on the upper surface of the piston 149 while tubing pressure passes through ports 155 into chamber 156 and is effective in an upward direction on the piston 149. The travel joint operates in the manner explained in conjunction with FIG. 1.

FIG. 7 shows schematically the combination of any of the systems and methods previously explained in conjunction with using the gas in the tubing as a means for pressurizing the piston of the subsurface safety valve and for supplying lifting gas to the fluid rising in the annulus.

The well is shown to be cased at 162 and to have a packer 163 above the producing formation 164. The subsurface safety valve and travel joint are indicated generally at 165.

A plurality of gas lift valves 166 and 167 are shown on the tubing 168. As will be apparent to those skilled in the art, these valves might be interior of the tubing in side pocket mandrels.

At the surface the wellhead includes the pipe 169 for conducting fluid passing through the annulus to equipment for treating the products of the well.

The tubing is connected to a means 171 for providing gas under pressure for pressurizing the tubing 168 to operate the subsurface safety valve and for introducing gas into the annulus through one or more gas lift valves 166 and 167 to assist in raising the fluid in the annulus to the surface.

From the above it is apparent that the several methods of operation described above can be carried out with the several structures illustrated in FIGS. 1 through 7, but other structures may also be utilized in carrying out the methods described and claimed herein.

The foregoing disclosure and description of the invention are illustrative and explanatory thereof and various changes in the size, shape and materials and in the method may be made within the scope of the appended claims without departing from the spirit of the invention.

What is claimed is:

1. An annulus flow system for wells comprising, a packer having seal means thereon adapted to be landed in a well, a subsurface safety valve associated with said packer, a flowway through said packer and safety valve providing fluid communication between the exterior of said packer above and below said seal means, said safety valve having valve means controlling flow through said flowway and a pressure responsive means controlling said valve means, and yieldable means urging said pressure responsive means in a downward direction, said pressure responsive means exposed to a control pressure and reciprocating against said yieldable means to move said valve means between open and closed position in response to changes in said control pressure.

2. An annulus flow system for wells comprising, a packer having seal means thereon adapted to be landed in a well, a subsurface safety valve associated with said packer, a flowway through said packer and safety valve providing fluid communication between the exterior of said packer above and below said seal means, said safety valve having valve means controlling flow through said flowway and a pressure responsive means controlling said valve means, a travel joint, a weight string of tubing interconnecting said travel joint and pressure responsive means and exerting a downward force on said pressure responsive means, and means closing the lower end of said tubing, said pressure responsive means exposed to fluid in said tubing to exert an upward force on said tubing, said pressure responsive means and tubing cooperating to move said valve means between open and closed positions in response to changes in fluid pressure in said tubing.

3. The system of claim 2 in combination with pressure sensing means removable through said tubing, said pressure sensing means providing said means closing the lower end of said tubing and exposed to pressure fluid exterior of said packer and below said seal means in all positions of said valve means.

4. The system of claim 2 in combination with pressure sensing means removable through said tubing, said pressure sensing means exposed to pressure fluid exterior of said packer and below said seal means in all positions of said valve means through a test passage, and check valve means in said test passage held in unseated position by said pressure sensing means and effective to block flow through the test passage into said tubing when the pressure sensing means is removed.

5. The system of claim 2 wherein a purging valve communicates the tubing with the exterior of the packer below said seal means.

6. The system of claim 2 wherein the travel joint includes a pressure responsive member exposed to pressure within the tubing exerting an upward force on the tubing.

7. The system of claim 2 wherein the travel joint includes a pressure responsive member exposed on opposite sides to pressure within and without the tubing and the differential exerts an upward force on the tubing.

8. The system of claim 1 or 2 wherein the pressure responsive means is exposed to pressure exterior of the packer above said seal means and the differential in pressure across said pressure responsive means moves said valve means between open and closed positions.

9. The system of claim 2 wherein the pressure responsive means is exposed to pressure exterior of the packer above said seal means and the differential in pressure across said pressure responsive means urges said valve means between open and closed positions, and wherein the travel joint includes a pressure responsive member exposed on opposite sides to pressure within and without the tubing and the differential exerts an upward force on the tubing.

10. The system of claim 2 wherein the pressure responsive means is a piston exposed to pressure exterior of the packer above said seal means and the differential in pressure across said piston urges said valve means between open and closed positions, and wherein the travel joint includes a pressure responsive member exposed on opposite sides to pressure within and without the tubing and the differential exerts an upward force on the tubing.

11. An annular flow system for wells comprising, a packer having a bore therethrough and seal means thereon adapted to be landed in a well, a subsurface safety valve connected to said packer, said valve having a flowway providing fluid communication between the exterior of the valve and the bore through the packer, said safety valve having valve means controlling flow through said flowway and a pressure responsive means controlling said valve means, a travel joint, a weight string of tubing interconnecting said travel joint and pressure responsive means and exerting a downward force on said pressure responsive means, and means closing the lower end of said tubing, said pressure responsive means exposed to fluid in said tubing to exert an upward force on said tubing, said pressure responsive means and said tubing cooperating to move said valve means between open and closed position in response to changes in fluid pressure in said tubing.

12. The system of claim 10 in combination with pressure sensing means removable through said tubing, said pressure sensing means providing said means closing the lower end of said tubing and exposed to pressure fluid exterior of said packer and below said seal means in all positions of said valve means.

13. The system of claim 11 in combination with pressure sensing means removable through said tubing, said pressure sensing means exposed to pressure fluid exterior of said packer and below said seal means in all positions of said valve means through a test passage, and check valve means in said test passage held in unseated position by said pressure sensing means and effective to block flow through the test passage when the pressure sensing means is removed.

14. The system of claim 11 wherein a purging valve communicates the tubing with the exterior of the packer below said seal means.

15. The system of claim 11 wherein the travel joint includes a pressure responsive member exposed to pressure within the tubing exerting an upward force on the tubing.

16. The system of claim 11 wherein the travel joint includes a pressure responsive member exposed on opposite sides to pressure within and without the tubing and the differential exerts an upward force on the tubing.

17. The system of claim 11 wherein the pressure responsive means is exposed to pressure exterior of the packer above said seal means and the differential in pressure across said pressure responsive member moves said valve means between open and closed positions.

18. The system of claim 11 wherein the pressure responsive means is exposed to pressure exterior of the packer above said seal means and the differential in pressure across said pressure responsive means urges said valve means between open and closed positions, and wherein the travel joint includes a pressure responsive member exposed on opposite sides to pressure within and without the tubing and the differential exerts an upward force on the tubing.

19. The system of claim 11 wherein a foot valve is carried by said packer and a stinger on said safety valve opens said foot valve when the safety valve is connected to the packer and closes said foot valve when the safety valve is released from the packer.

20. The system of claims 1, 2, 11, 12, 13, 14, 15, 16, 17, 18, or 19, in combination with a well tubing extending to the surface of the well and at least one gas lift valve controlling flow from the interior to the exterior of the well tubing, and means for supplying gas under pressure to said tubing to pressurize said pressure responsive means and provide gas for lifting fluids in the well annulus.

21. A subsurface safety valve comprising, a housing having a flowway therethrough, valve means controlling flow through said flowway, a valve actuator connected to said valve means, a piston carried by the valve actuator, a weight string of tubing carried by the valve actuator, a travel joint connected to said weight string of tubing and exposed to pressure within and without said tubing, said piston exposed to pressure fluid in said tubing to exert an upward force on said tubing and to pressure externally of said tubing to exert a downward force on said tubing, said piston and tubing cooperating to move said valve means between said open and closed positions in response to changes in differential across said piston.

22. The method of operating a subsurface safety valve having a housing with a flowway therethrough, valve means controlling flow through the flowway, a valve actuator connected to said valve means, a pressure responsive member carried by the valve actuator, a weight string of tubing carried by the valve actuator, a travel joint connected to said weight string of tubing and exposed to pressure within and without said tubing, said pressure responsive member exposed to pressure fluid in said tubing to exert an upward force on said actuator and to pressure externally of said tubing to exert a downward force on said actuator comprising;

pressurizing the tubing to a level which almost closes the valve means and which will permit the valve means to move to closed position against the weight of the weight string of tubing when pressure exterior of the tubing reduces to a selected value whereby the valve means will automatically close when pressure exterior of the tubing reduces to a selected value.

23. An annular flow system for wells comprising, a packer having sealing means thereon adapted to be landed in a well, a slide valve carried by said packer, said slide valve having a housing with a bore therethrough and side valve ports, a tubular slide valve member movable between positions opening and closing said ports, a valve operator releasably landed in said packer, said operator having a tubular stinger extending through said slide valve and into sealing engagement with the bore in said housing, said stinger and valve member having releasable engaging means for moving said valve member between open and closed positions with reciprocation of said stinger, pressure responsive means in said valve operator, a weight string of tubing connected to said pressure responsive means, said pressure responsive means exposed on its downwardly facing pressure responsive surface to pressure fluid in said tubing whereby said tubing and pressure responsive means cooperate in response to changing pressure in said tubing to reciprocate said stinger and move said valve member between open and closed positions, a landing nipple in said tubing, a pressure measuring means removably landed in said nipple, and a fluid conduit between said stinger and said nipple for conducting well fluid to said pressure measuring means.

24. The system of claim 23 in combination with a travel joint on the upper end of said tubing.

25. The system of claim 23 or 24 wherein a valve is provided in said fluid conduit which is held unseated by said pressure measuring means and prevents flow of fluid through said fluid conduit when the pressure measuring means is removed.

26. The method of operating an annulus flow system having a wellhead from which a casing and tubing depend providing an annulus therebetween, a packer and associated subsurface safety valve controlling flow from below the packer into the annulus above the packer and a valve operator with a weight string of tubing urging the operator down and a pressure responsive member exposed to tubing pressure urging the operator upwardly and a landing nipple in the tubing exposed to pressure below the packer comprising:

running a pressure measuring instrument into the tubing and landing the instrument in the landing nipple;

alternately raising and lowering the pressure in the tubing to open and close the safety valve to obtain pressure buildup curve and flowing well data;

removing said instrument;

landing a plug in said nipple;

pressuring said tubing to a selected value to maintain said safety valve open; and reducing the pressure in said tubing in response to a selected condition at the wellhead to close said safety valve.

27. The method of operating an annulus flow system having a casing and tubing providing an annulus therebetween, a packer and associated subsurface safety valve controlling flow from below the packer into the annulus above the packer and a valve operator with a weight string of tubing urging the operator down and a pressure responsive member exposed on one side to tubing pressure and on the other side to annulus pressure and a landing nipple in the tubing exposed to pressure below the packer comprising:

running a pressure measuring instrument into the tubing and landing the instrument in the landing nipple;

alternately raising and lowering the pressure in the tubing to open and close the safety valve to obtain pressure buildup curve and flowing well data;

removing said instrument and landing a plug in the landing nipple; and pressuring said tubing to a selected value to open said safety valve;

said safety valve closing in response to annulus pressure reducing to a selected level.

28. The method of operating an annulus flow system having a wellhead from which a casing and tubing depend providing an annulus therebetween, a packer and associated subsurface safety valve controlling flow from below the packer into the annulus above the packer and a valve operator with a weight string of tubing urging the operator down and a pressure responsive member exposed to the differential between annulus and tubing pressure and a landing nipple exposed to pressure below the packer in the tubing comprising:

running a pressure measuring instrument into the tubing and landing the instrument in the landing nipple;

alternately raising and lowering the pressure in the tubing to open and close the safety valve to permit obtaining pressure buildup curve and flowing well data;

removing said instrument;

pressuring said tubing to a selected value to maintain said safety valve open; and reducing the pressure in said tubing in response to a selected condition at the wellhead to close said safety valve.

29. The method of claim 27 or 28 wherein after the instrument is removed, a plug is landed in said landing nipple.

30. The method of operating an annulus flow system having a casing and tubing providing therebetween an annulus, a packer and associated subsurface safety valve controlling flow from below the packer into the annulus above the packer and a valve operator with a weight string of tubing urging the operator down and a pressure responsive member exposed to the differential between annulus and tubing pressure and a landing nipple in the tubing comprising:

running a pressure measuring instrument into the tubing and landing the instrument in the landing nipple;

alternately raising and lowering the pressure in the tubing to open and close the safety valve to permit obtaining pressure buildup curve and flowing well data;

removing said instrument; and pressuring said tubing to a pressure approximately that of flowing annulus pressure resulting in a differential in pressure exerting a force on the piston slightly greater than the force exerted by the weight of string of tubing to maintain said pressure valve open until annulus pressure reduces to a level permitting the differential across the piston to close the safety valve.

31. The method of claims 26, 27, 28 or 30 wherein tubing pressure is provided by maintaining a selected level of liquid within the tubing and a pressurized gas cap is maintained on the liquid.

32. The method of claims 22, 23, 24, 26, 27, 28 or 30 wherein at least a portion of the pressure on the pressure responsive member is provided by gas under pressure in the well tubing and said gas also is passed through gas lift valves into the casing-tubing annulus to lift fluids therein.

33. The method of operating a subsurface safety valve having a housing with a flowway therethrough, valve means controlling flow through the flowway, a valve actuator connected to said valve means, a pressure responsive member carried by the valve actuator, a weight string of tubing carried by the valve actuator, a travel joint connected to said weight string of tubing and exposed to pressure within and without said tubing, said pressure responsive member exposed to pressure fluid within said tubing to exert an upward force in said actuator comprising:

pressurizing the tubing to a level which almost closes the valve means, and increasing pressure in the tubing to close the valve in response to a selected condition to close said safety valve.

34. A subsurface safety valve comprising, a housing having a flowway therethrough, valve means controlling flow through said flowway, a valve actuator connected to said valve means, a piston carried by the valve actuator, a weight string of tubing carried by the valve actuator, said piston exposed to pressure fluid in said tubing to exert an upward force on said tubing and to pressure externally of said tubing to exert a downward force on said tubing, said piston and tubing cooperating to move said valve means between said open and closed positions in response to changes in differential across said piston, said valve means provided by a sleeve valve member and seat, and a shuttle valve provided with latch means which latch the shuttle valve to the sleeve valve member when the valve member is in open position and to the valve seat when the valve is in closed position.

* * * * *